US010843849B1

(12) United States Patent
Berge

(10) Patent No.: US 10,843,849 B1
(45) Date of Patent: Nov. 24, 2020

(54) FLIP TOP DISPENSING CLOSURE

(71) Applicant: Silgan White Cap LLC, Downers Grove, IL (US)

(72) Inventor: Gary L. Berge, Crystal Lake, IL (US)

(73) Assignee: Silgan White Cap LLC, Downers Grove, IL (US)

( * ) Notice: Subject to any disclaimer, the term of this patent is extended or adjusted under 35 U.S.C. 154(b) by 0 days.

(21) Appl. No.: 16/590,135

(22) Filed: Oct. 1, 2019

(51) Int. Cl.
*B65D 47/08* (2006.01)

(52) U.S. Cl.
CPC .... *B65D 47/0857* (2013.01); *B65D 2547/066* (2013.01)

(58) Field of Classification Search
CPC ..... B65D 47/0857; B65D 2547/066
USPC ..... 222/556
See application file for complete search history.

(56) References Cited

U.S. PATENT DOCUMENTS

| | | | | | |
|---|---|---|---|---|---|
| 4,936,494 | A * | 6/1990 | Weidman | B65D 47/0847 | 215/235 |
| 5,934,496 | A * | 8/1999 | Mogard | B65D 47/103 | 220/258.3 |
| 6,116,477 | A * | 9/2000 | Kreiseder | B65D 47/0857 | 222/546 |
| 6,367,670 | B1 * | 4/2002 | Warner | B65D 47/0804 | 222/556 |
| 7,510,095 | B2 * | 3/2009 | Comeau | B65D 35/08 | 215/235 |
| 7,900,789 | B2 * | 3/2011 | Johnston | B65D 55/022 | 215/330 |
| 2007/0194047 | A1 * | 8/2007 | Tauber | B65D 47/122 | 222/109 |
| 2009/0101646 | A1 * | 4/2009 | Paul | A47F 7/28 | 220/254.4 |
| 2009/0242564 | A1 * | 10/2009 | Danks | B65D 47/0838 | 220/361 |

* cited by examiner

*Primary Examiner* — Jeremy Carroll
(74) *Attorney, Agent, or Firm* — Reinhart Boerner Van Deuren s.c.

(57) ABSTRACT

A includes a body and a top structure coupled to the body. The body includes a top panel and two annular walls extending in a same direction from a surface of the top panel. One or more ribs extend from the top panel between the inner annular wall and the outer annular wall.

19 Claims, 9 Drawing Sheets

FLIP TOP DISPENSING CLOSURE

BACKGROUND

The present invention relates to a container assembly having a flip top closure. The flip top closure includes several internal ribs that mitigate deformation of the closure's outer annular wall.

SUMMARY OF THE INVENTION

In one embodiment, a flip top closure includes a top panel, an inner annular wall, an outer annular wall surrounding the inner annular wall, a hinge pivotally coupling a top structure to the top panel, and a plurality of ribs. The inner annular wall extends from a lower surface of the top panel and defines a longitudinal axis around which the inner annular wall extends. The inner annular wall includes threads that extend radially inward towards the longitudinal axis. The outer annular wall radially surrounds the inner annular wall. The plurality of ribs extend from the top panel between the inner and outer annular walls. The plurality of ribs are located near a front of the closure and/or the top panel.

In one embodiment the front of closure is defined as being radially aligned with a center of one or more tongues on the top structure and closure body that interface when the top top structure is in a closed position. In one embodiment, the front of closure is defined as being radially aligned with a center of the hinge that pivotally couples the top structure and the top panel. In one embodiment the front is defined as being radially aligned with an elongate portion of the aperture in the top panel through which contents of the container are removed (e.g., the aperture through which the container contents are poured).

Additional features and advantages will be set forth in the detailed description which follows, and in part will be readily apparent to those skilled in the art from the description or recognized by practicing the embodiments as described in the written description and claims hereof, as well as the appended drawings. It is to be understood that both the foregoing general description and the following detailed description are exemplary.

The accompanying drawings are included to provide a further understanding and are incorporated in and constitute a part of this specification. The drawings illustrate one or more embodiments and together with the description serve to explain principles and operation of the various embodiments.

BRIEF DESCRIPTION OF THE DRAWINGS

This application will become more fully understood from the following detailed description, taken in conjunction with the accompanying figures, wherein like reference numerals refer to like elements in which.

DETAILED DESCRIPTION

Figure 1:
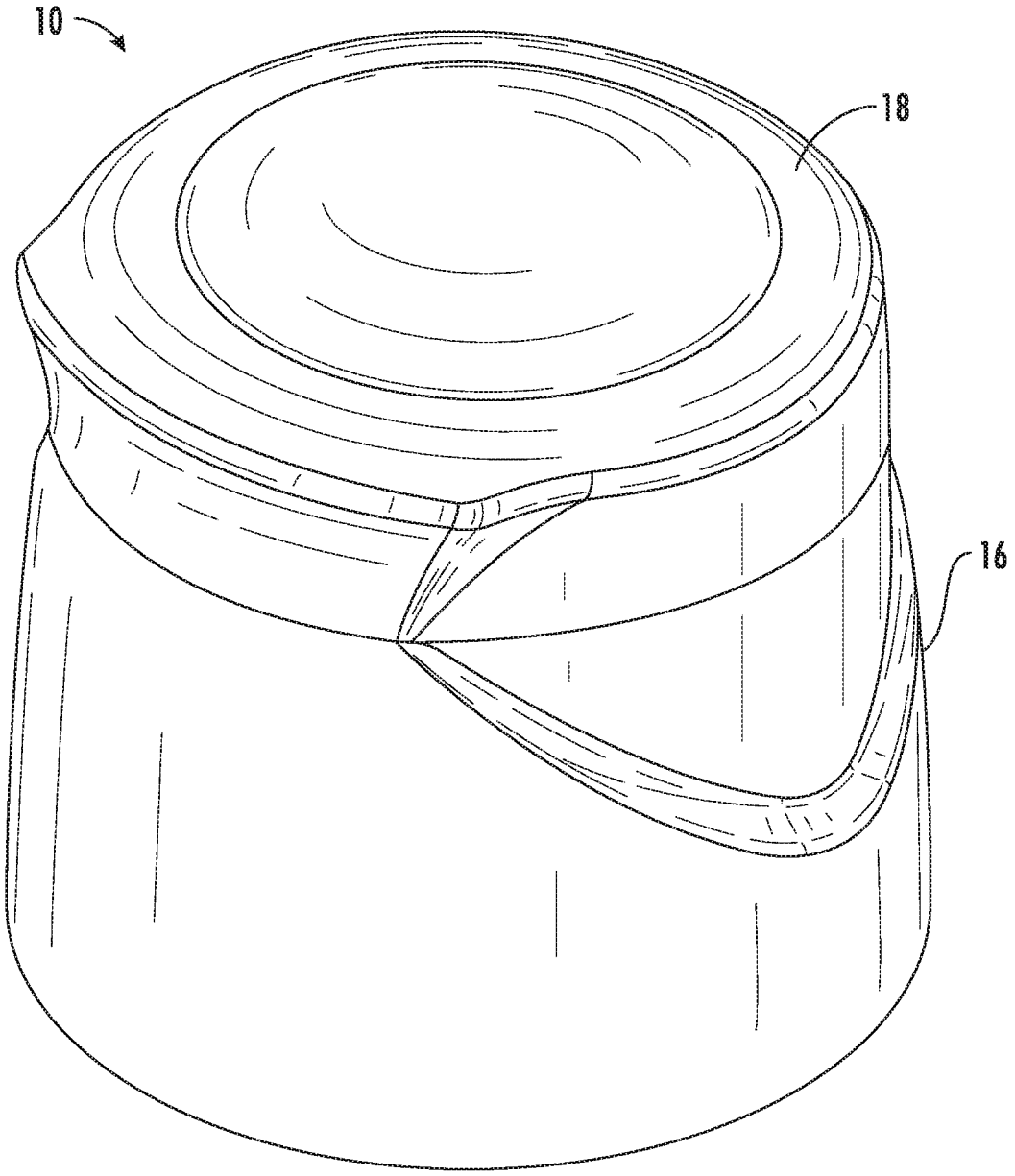
FIG. 1 is a perspective view from above of a flip top closure, according to an exemplary embodiment.
Figure 2:
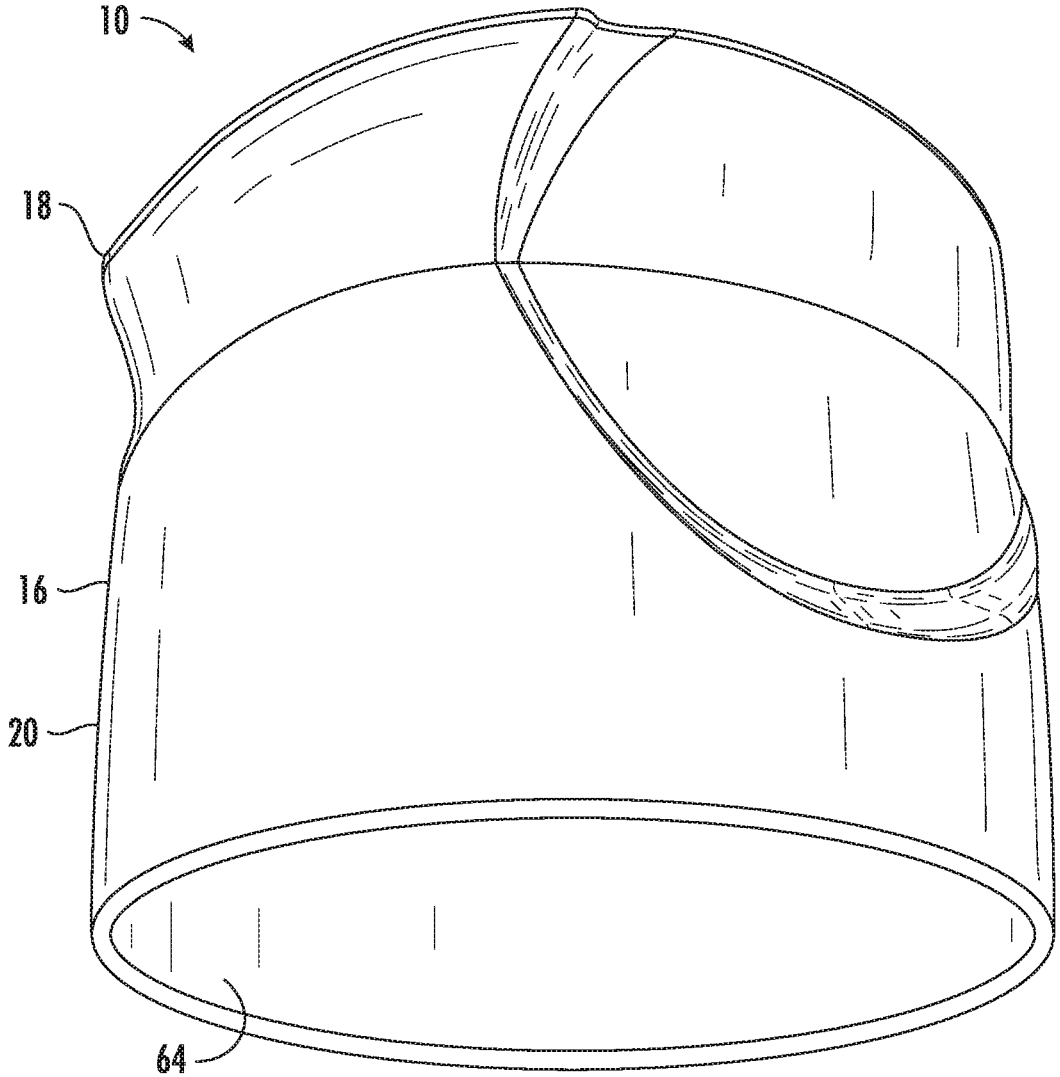
FIG. 2 is a perspective view from below of the flip top closure of FIG. 1, according to an exemplary embodiment.
Figure 3:
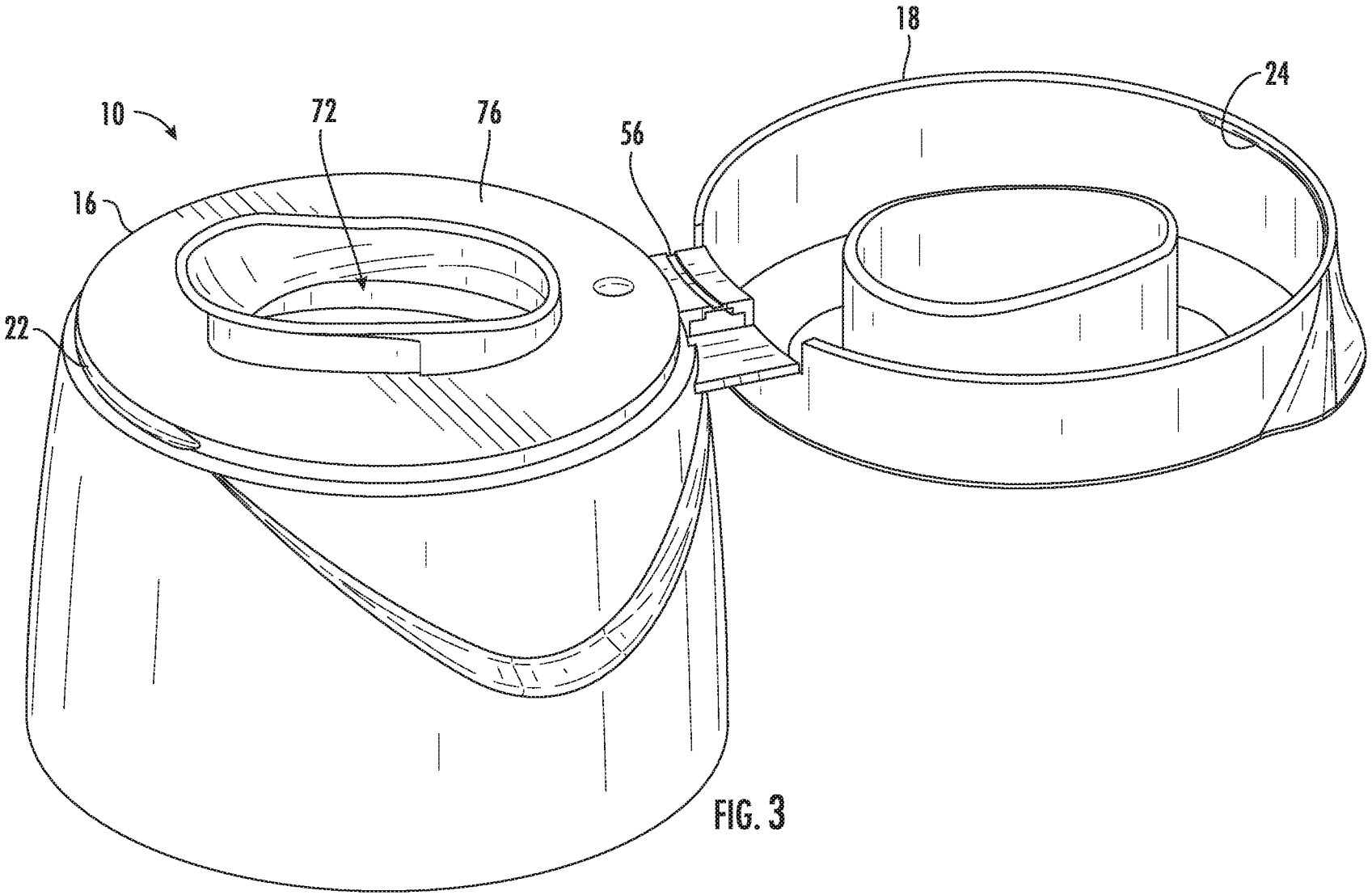
FIG. 3 is a perspective view from above of the flip top closure of FIG. 1 in an open position, according to an exemplary embodiment.
Figure 4:
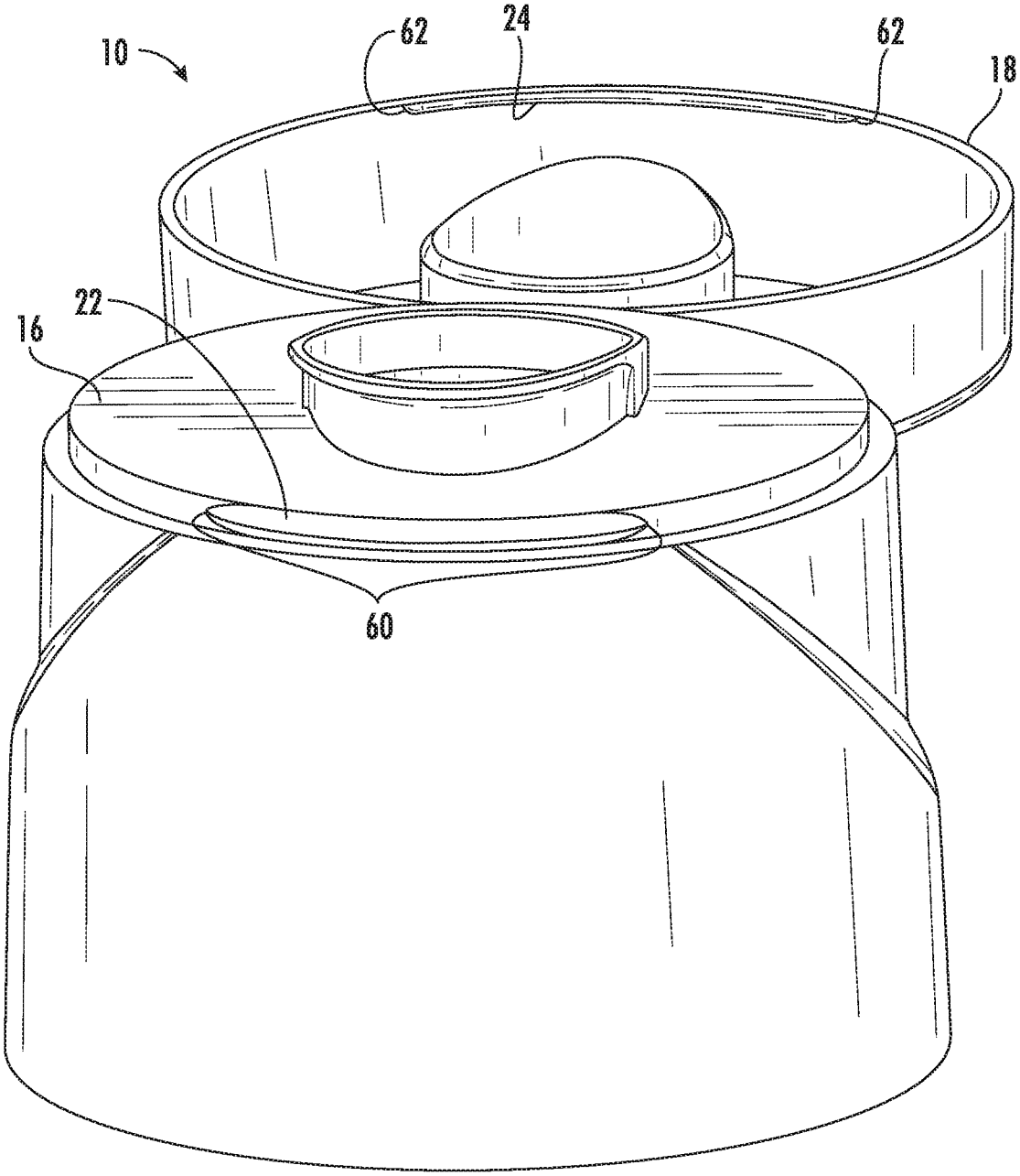
FIG. 4 is a perspective view from above of the flip top closure of FIG. 1 in the open position, according to an exemplary embodiment.

Referring generally to the figures, various embodiments of a closure are described. In particular embodiments, a closure includes a top structure coupled to a top panel. Inner and outer annular walls extend from the top panel around a longitudinal axis. A plurality of ribs extend from the top panel between the inner and outer annular walls.

The ribs are positioned such that they reduce the volume of material required (thus reducing the costs of the closure) while providing improved structural support at an important location or range of locations in the closure. In one embodiment the closure includes a plurality of ribs located within the front of the closure near a latching mechanism that resists the top structure being pivotally rotated with respect to the top panel.

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

FIGS. 1-4 shows a closure 10 according to one embodiment. Closure 10 includes a top structure 18 pivotally coupled to body 16 and/or top panel 76, such as via hinge 56. Hinge 56 permits pivotal rotation of top structure 18 with respect to top panel 76. Hinge 56 is located at top panel 76 opposite a front 58 of top panel 76.

Outer annular wall 20 extends downwardly from a periphery of top panel 76. Top panel 76 defines aperture 72, which is configured to allow contents to pour from the container that closure 10 is affixed to.

Tongue 22 extends radially outward from top panel 76. Top structure 18 comprises tongue 24 that extends radially inwards. When top structure 18 is in the closed position (best shown FIG. 1), tongue 22 and tongue 24 interface against each other to resist top structure being pivotally opened to expose aperture 72. Tongue 22 extends between outer edges 60, and tongue 24 extends between outer edges 62. In one embodiment, tongue 22 and/or tongue 24 extend 60 arcuate degrees with respect to longitudinal axis 12.

Figure 5:
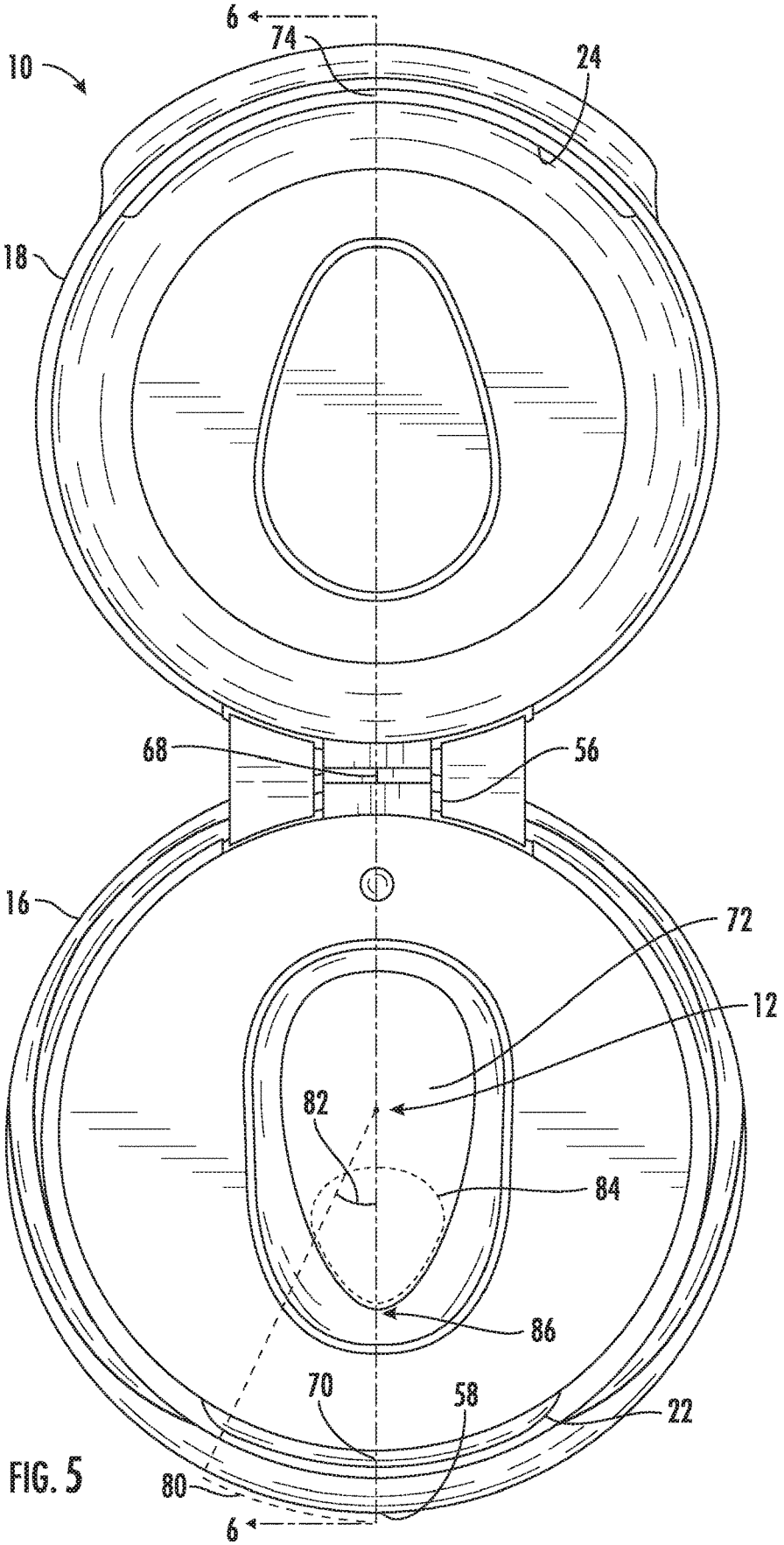
FIG. 5 is a top view of the flip top closure of FIG. 1 in the open position, according to an exemplary embodiment.
Figure 6:
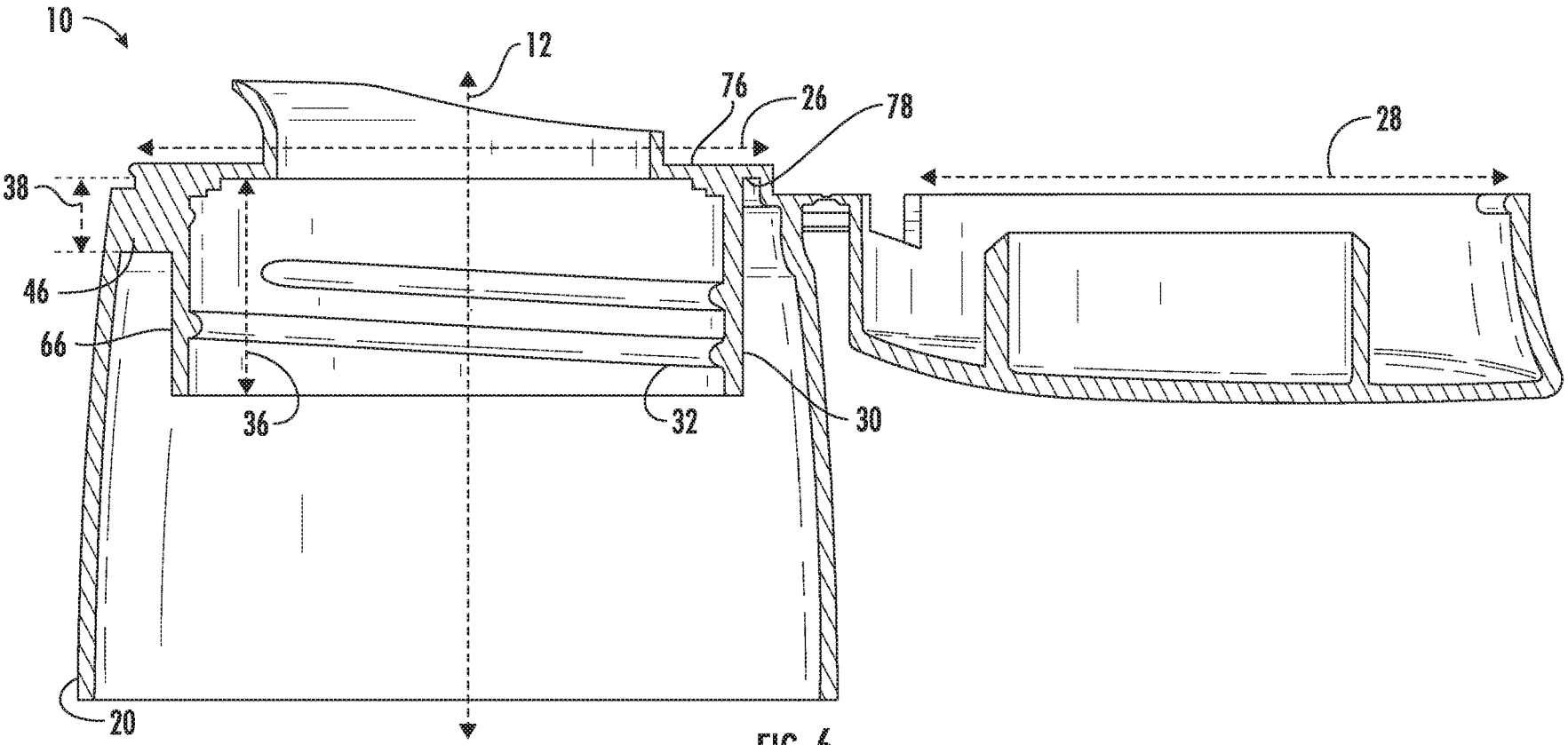
FIG. 6 is a cross-sectional side view of the flip top closure of FIG. 5 taken along the plane A-A in FIG. 5, according to an exemplary embodiment.

Turning to FIGS. 5-6, tongue 22 defines a center 70, and tongue 24 defines center 74. Both center 70 and center 74 are radially aligned with a front 58 of top panel 76. Longitudinal axis 12 is within aperture 72. Aperture 72 includes an elongate section 84 that extends further from longitudinal axis 12. Elongate section 84 of aperture 72 defines a center 86. Center 86 of elongate section 84 extends furthest from longitudinal axis 12 of any portion of aperture 72, and is radially aligned with front 58 of top panel 76.

In the embodiment shown, front 58 of top panel 76 is aligned with the plane defined by center 70, center 74, and center 86 (shown as plane A-A in FIG. 5). Second rib 46 is positioned along the plane defined by each of center 70, center 74, and center 86. Second rib 46 extends a distance 38 from top panel 76 and between exterior surface 66 of inner annular wall 30 and interior surface 64 of outer annular wall 20.

Inner annular wall 30 extends a distance 36 downwardly from bottom surface 78 of top panel 76. Inner annular wall 30 defines and extends around longitudinal axis 12. Thread 32 extends inwardly from inner annular wall 30 towards longitudinal axis 12.

In various embodiments, closure 10 may be formed from a molded plastic material. In various embodiments, closure 10 may be polyethylene, polypropylene, polyethylene terephthalate, or any other suitable plastic material. In various embodiments, the closure 10 may be formed through any suitable molding method including injection molding, compression molding, etc.

Length 26 of body 16 is similar to length 28 of top structure 18. As a result, tongue 22 and tongue 24 interface against each other when top structure is pivotally rotated from a closed position.

Looking more specifically at FIG. 5, plurality of ribs 88 are located within arc 80 with respect to front 58. As shown, arc 80 covers angle 82, which is 22.5 degrees. It is to be understand that arc 80 extends in both arcuate directions from front 58.

Figure 7:
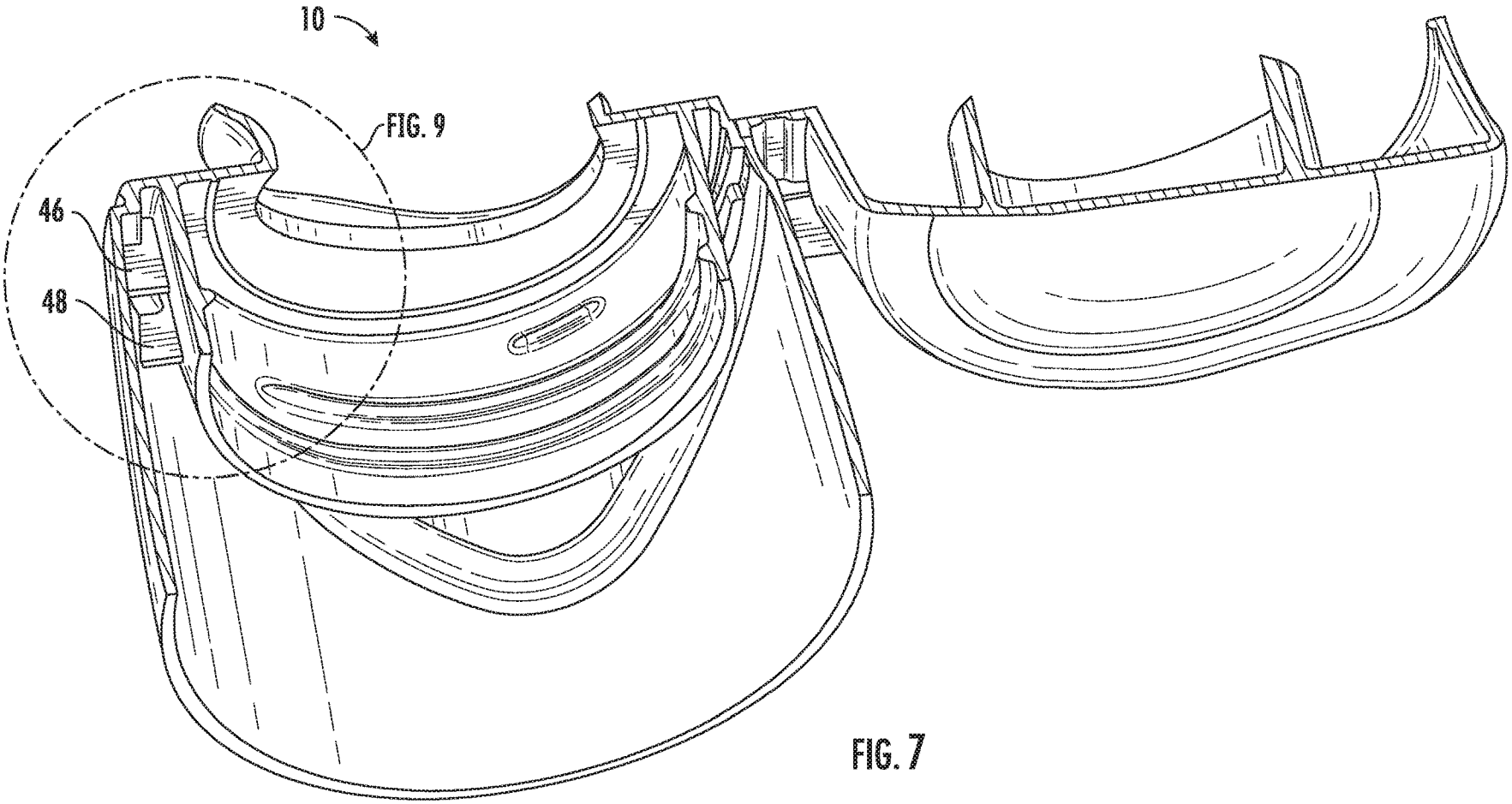
FIG. 7 is a perspective view of a cross-section of the flip top closure of FIG. 6 taken from a lower and slightly rotated perspective compared to FIG. 6, according to an exemplary embodiment.
Figure 8:
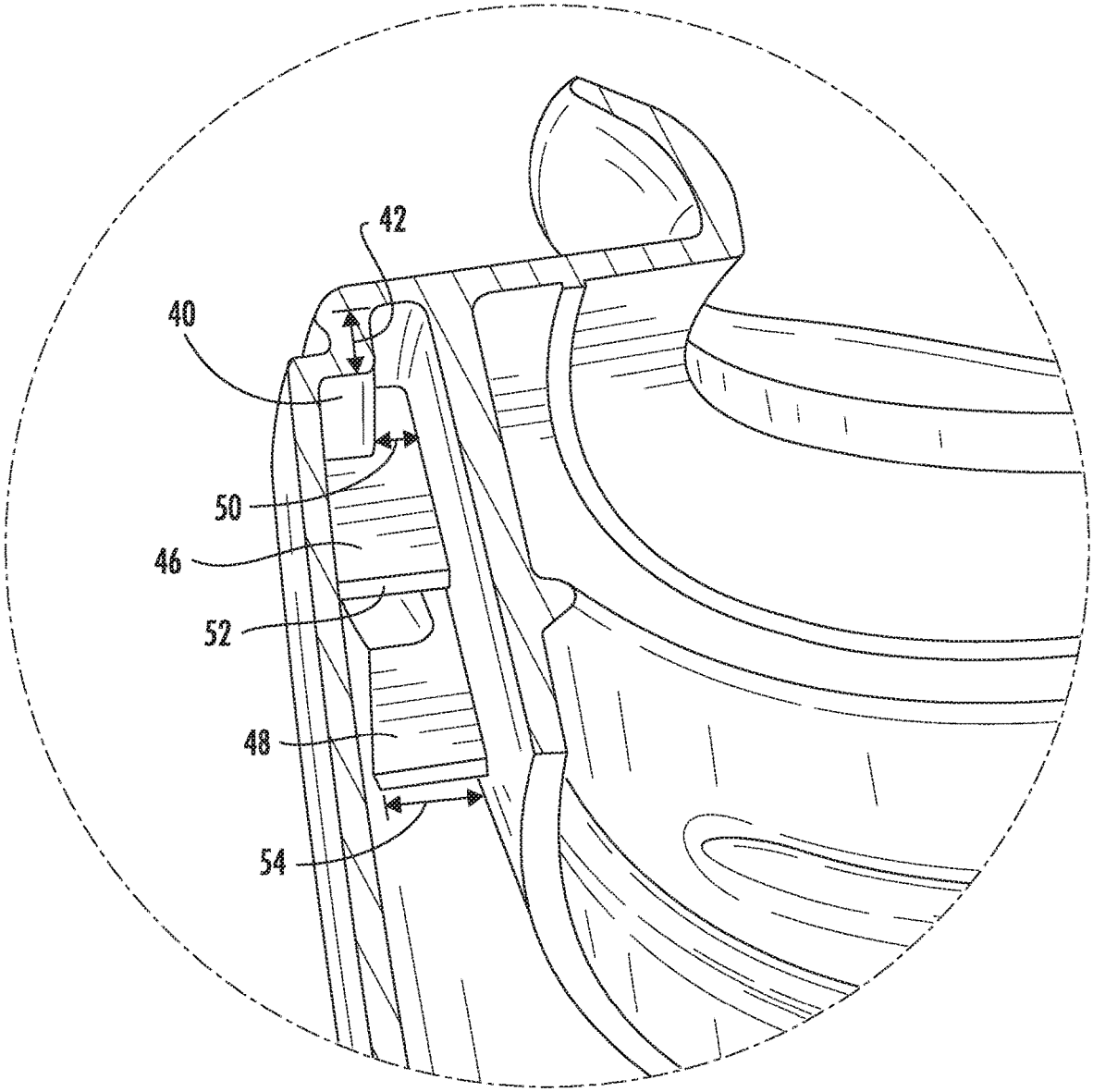
FIG. 8 is a detailed cross-sectional perspective view from below of the flip top closure of FIG. 7, according to an exemplary embodiment.
Figure 9:
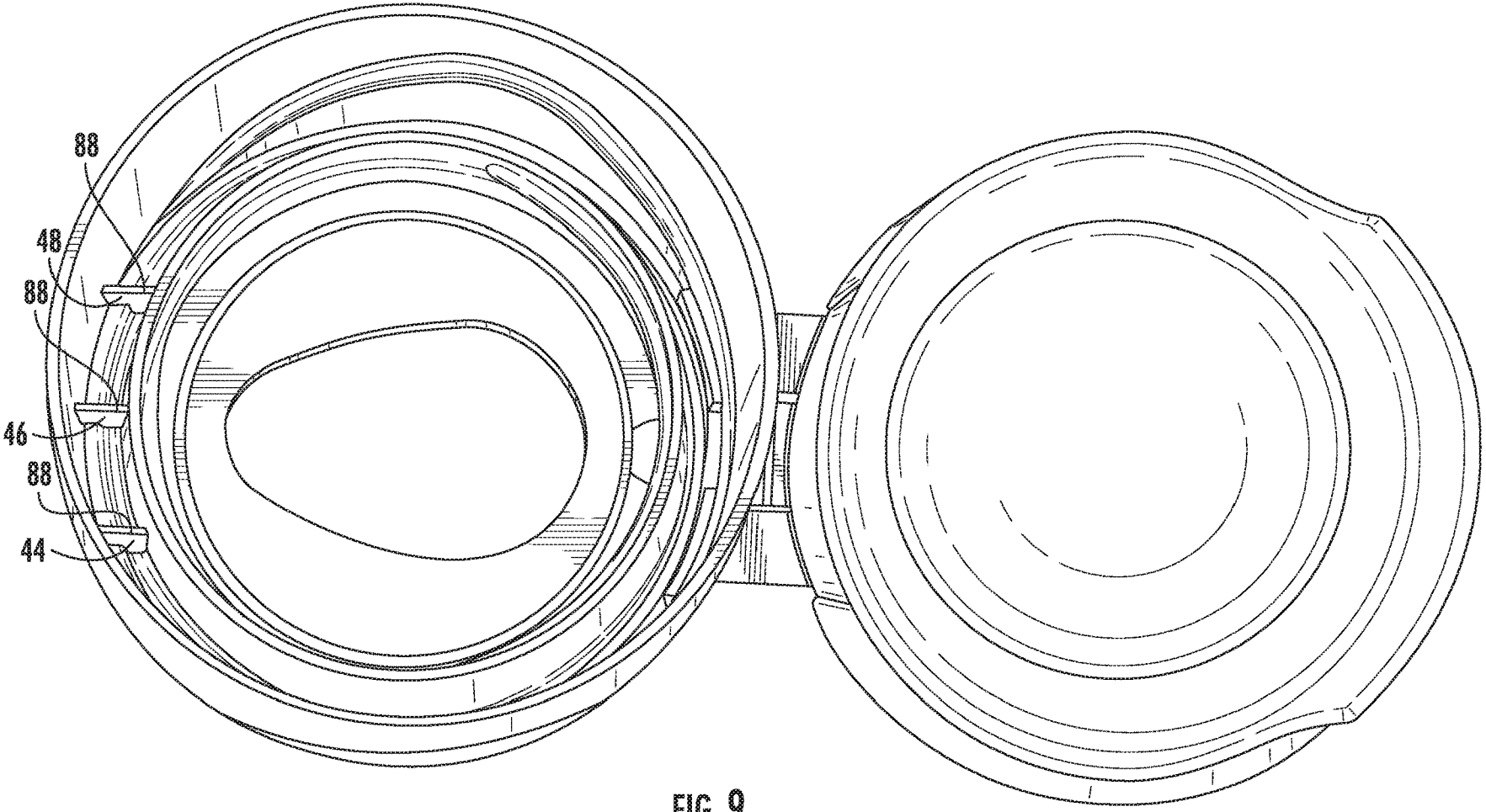
FIG. 9 is a perspective view of the flip top closure of FIG. 1 in the open position, according to an exemplary embodiment.

Turning to FIGS. 7-9, FIG. 7 is a perspective view of a cross-section of closure 10 taken from a lower and slightly rotated viewpoint compared to FIG. 6. This perspective illustrates the size and positioning of several of ribs 88 as compared to inner annular wall 30, outer annular wall 20, and shelf 40.

Closure 10 comprises three ribs 88 that extend downwardly from top panel, shown as first rib 44, second rib 46, and third rib 48. As shown in FIG. 8 in particular, annular shelf 40 extends height 42 from bottom surface 78 of top panel 76. Second rib 46 extends a width 50 at shelf 40, and extends a width 54 at a bottom surface 52 of second rib 46. In one embodiment, first rib 44 and third rib 48 are similarly configured.

Closure 10 includes a plurality of ribs 88 located near a front 58 of top panel 76. In one embodiment front 58 is defined as being radially aligned with center 74 of tongue 24 extending from top structure 18. In one embodiment front 58 is defined as being radially aligned with center 70 of tongue 22 extending from body 16. In one embodiment front 58 is defined as being radially aligned with center 68 of hinge 56. In one embodiment front 58 is defined as being radially aligned with center 86 of elongate section 84 of aperture 72.

It is contemplated herein that a plurality of ribs are located within 30 arcuate degrees of front 58 of top panel 76 with respect to longitudinal axis 12 (for a total range of 60 arcuate degrees over which the three ribs are located), or more particularly within 22.5 arcuate degrees of front 58 of top panel 76 with respect to longitudinal axis 12 (for a total range of 45 arcuate degrees over which the three ribs are located), or more particularly within 20 arcuate degrees of front 58 of top panel 76 with respect to longitudinal axis 12 (for a total range of 40 arcuate degrees over which the three ribs are located), or more particularly within 15 arcuate degrees of front 58 of top panel 76 with respect to longitudinal axis 12 (for a total range of 30 arcuate degrees over which the three ribs are located).

In one embodiment closure 10 includes a plurality of ribs, at least some of which are within the defined arc 80. In one embodiment all of the ribs for closure 10 that extend from bottom surface 78 of top panel 76 between inner annular wall 30 and outer annular wall 20 are located with the identified arc 80.

In one embodiment, closure 10 includes exactly three ribs that extend downwardly from lower surface 78 of top panel 76 between inner annular wall 30 and outer annular wall 20.

In one embodiment, the plurality of ribs 88 are symmetrically located within the defined front portion of top panel 76 (e.g., arc 80). In one embodiment, the plurality of ribs 88 are parallel with respect to each other. In one embodiment, one or more of the plurality of ribs 88 are radially aligned (e.g., second rib 46 in FIG. 9).

In one embodiment inner annular wall 30 extends a height 36 from bottom surface 78 of top panel 76, and the plurality of ribs 88 extend height 38 from bottom surface 78 of top panel 76. In one embodiment at least one of the plurality of ribs 88 extends less than 50% a distance that inner annular wall 30 extends from bottom surface 78, or more particularly at least one of the plurality of ribs 88 extends less than 45% a distance that inner annular wall 30 extends from bottom surface 78, or more particularly at least one of the plurality of ribs 88 extends less than 40% a distance that inner annular wall 30 extends from bottom surface 78, or more particularly at least one of the plurality of ribs 88 extends less than 35% a distance that inner annular wall 30 extends from bottom surface 78, or more particularly at least one of the plurality of ribs 88 extends less than 33% a distance that inner annular wall 30 extends from bottom surface 78.

In one embodiment, shelf 40 extends a height 42 from bottom surface 78, and at least one of the plurality of ribs 88 extends a height 38 from bottom surface 78. In one embodiment the height 42 of shelf 40 is less than 50% of the height 38 of the at least one of the plurality of ribs 88, or more particularly the height 42 of shelf 40 is less than 45% of the height 38 of the at least one of the plurality of ribs 88, or more particularly the height 42 of shelf 40 is less than 40% of the height 38 of the at least one of the plurality of ribs 88, or more particularly the height 42 of shelf 40 is less than 35% of the height 38 of the at least one of the plurality of ribs 88, or more particularly the height 42 of shelf 40 is less than 33% of the height 38 of the at least one of the plurality of ribs 88.

In one embodiment, arc 80 over which plurality of ribs 88 are positioned is defined with respect to center 70, center 74, and/or center 86. In one embodiment, arc 80 is defined with respect to outer edges 60 of tongue 22 (e.g., arc 80 is equal to outer edges 60, arc 80 extends 10 arcuate degrees more or less than outer edges 60, arc 80 extends 20 arcuate degrees more or less than outer edges 60). In one embodiment, arc 80 is defined with respect to outer edges 62 of tongue 24 (e.g., arc 80 is equal to outer edges 62, arc 80 extends 10 arcuate degrees more or less than outer edges 62, arc 80 extends 20 arcuate degrees more or less than outer edges 62).

In one embodiment, closure 10 includes a rearward rib positioned opposite front 58, which is spaced 180 circumferential degrees from front 58, and one or more lateral ribs positioned 90 and/or 270 degree circumferential degrees from front 58. In a specific embodiment closure 10 includes one or more of ribs 44, 46 and 48 and one or more of rearward rib and lateral ribs.

Further modifications and alternative embodiments of various aspects of the invention will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. Other substitutions, modifications, changes and omissions may also be made in the design, operating conditions and arrangement of the various exemplary embodiments without departing from the scope of the present invention.

For purposes of this disclosure, the term "coupled" or "attached to" means the joining of two components directly or indirectly to one another. Such joining may be stationary in nature or movable in nature. Such joining may be achieved with the two members and any additional intermediate members being integrally formed as a single unitary body with one another or with the two members or the two members and any additional member being attached to one another. Such joining may be permanent in nature or alternatively may be removable or releasable in nature.

In various exemplary embodiments, the relative dimensions, including angles, lengths and radii, as shown in the Figures are to scale. Actual measurements of the Figures will disclose relative dimensions, angles and proportions of the various exemplary embodiments. Various exemplary embodiments extend to various ranges around the absolute and relative dimensions, angles and proportions that may be determined from the Figures. Various exemplary embodiments include any combination of one or more relative dimensions or angles that may be determined from the Figures. Further, actual dimensions not expressly set out in this description can be determined by using the ratios of dimensions measured in the Figures in combination with the express dimensions set out in this description. It should also be understood that the terminology is for the purpose of description only and should not be regarded as limiting.

While the current application recites particular combinations of features in the claims appended hereto, various embodiments of the invention relate to any combination of any of the features described herein whether or not such combination is currently claimed, and any such combination of features may be claimed in this or future applications. Any of the features, elements, or components of any of the exemplary embodiments discussed above may be used alone or in combination with any of the features, elements, or components of any of the other embodiments discussed above in the implementation of the teachings of the present disclosure.

What is claimed is:

1. A closure for use with a container, the closure comprising:

a top panel defining a lower surface;

an inner annular wall extending from the lower surface of the top panel, the inner annular wall defining a longitudinal axis around which the inner annular wall extends, the inner annular wall comprising threads that extend inwardly towards the longitudinal axis;

a hinge coupled to the top panel, a center of the hinge is opposite a front of the top panel with respect to the longitudinal axis;

a top structure pivotally coupled to the top panel via the hinge;

an outer annular wall extending from the top panel, the outer annular wall radially surrounding the inner annular wall; and a plurality of ribs extending from the top panel between the inner annular wall and the outer annular wall, wherein no ribs extend from the top panel and between the inner annular wall and the outer annular wall that are located more than 30 arcuate degrees from the front of the top panel.

2. The spout of claim 1, wherein no ribs extend from the top panel and between the inner annular wall and the outer annular wall that are located more than 22.5 arcuate degrees from the front of the top panel.

3. The spout of claim 1, wherein the plurality of ribs are symmetrically located with respect to a plane defined between the center of the hinge and the front of the top panel.

4. The spout of claim 1, wherein the plurality of ribs are parallel with respect to each other.

5. The spout of claim 1, wherein the plurality of ribs comprise at least three ribs.

6. The spout of claim 1, wherein the plurality of ribs consist of three ribs.

7. The spout of claim 1, wherein the inner annular wall extends a first height from the top panel, wherein the plurality of ribs extend a second height from the top panel, and wherein the first height of the inner annular wall is at least three times the second height of the plurality of ribs.

8. The spout of claim 1, wherein the top panel comprises a shelf that extends from the lower surface a first height, wherein the plurality of ribs extend a second height from the bottom surface of the top panel, and wherein the second height of the plurality of ribs is at least three times the first height of the shelf.

9. The spout of claim 1, wherein the top panel comprises a tongue protruding from the top panel radially away from the longitudinal axis, and wherein the top structure comprises a tongue extending radially inward when the top structure is in a closed position, wherein the top panel's tongue interfaces with the top structure's tongue when the top structure is in the closed position.

10. A closure for use with a container, the closure comprising:

a top panel defining a lower surface;

an inner annular wall extending from the lower surface of the top panel, the inner annular wall defining a longitudinal axis around which the inner annular wall extends, the inner annular wall comprising threads that extend inwardly towards the longitudinal axis;

a top structure pivotally coupled to the top panel;

an outer annular wall extending from the top panel, the outer annular wall radially surrounding the inner annular wall;

a first tongue protruding from the top panel radially away from the longitudinal axis, a center of the first tongue located at a front of the top panel;

a second tongue protruding from the top structure, the second tongue interfaces with the first tongue when the top structure is in a closed position; and a plurality of ribs extending from the top panel between the inner annular wall and the outer annular wall, wherein the plurality of ribs are symmetrically located with respect to a plane defined between the center of the hinge and the front of the top panel.

11. The spout of claim 10, wherein no ribs extend from the top panel between the inner annular wall and the outer annular wall that are located more than 22.5 arcuate degrees from the front of the top panel.

12. The spout of claim 10, wherein the plurality of ribs consist of three ribs, and wherein no ribs extend from the top panel between the inner annular wall and the outer annular wall that are located more than 22.5 arcuate degrees from the front of the top panel.

13. The spout of claim 10, wherein the plurality of ribs comprise at least three ribs.

14. The spout of claim 10, wherein the plurality of ribs are parallel with respect to each other.

15. The spout of claim 10, wherein at least two of the plurality of ribs are radially aligned with respect to the longitudinal axis.

16. The spout of claim 10, wherein the top panel comprises a shelf that extends from the lower surface a first height, wherein the plurality of ribs extend a second height from the bottom surface of the top panel, and wherein the second height of the plurality of ribs is at least three times the first height of the shelf.

17. A closure for use with a container, the closure comprising:

a top panel defining a lower surface;

an inner annular wall extending from the lower surface of the top panel, the inner annular wall defining a longitudinal axis around which the inner annular wall extends, the inner annular wall comprising threads that extend inwardly towards the longitudinal axis;

an aperture defined by the top panel, the longitudinal axis is located within the aperture, the aperture comprising an elongate section that extends from the longitudinal axis, a periphery of the elongate section comprising a frontal center point that is the furthest extending point in the aperture from the longitudinal axis, the frontal center point of the elongate section being radially aligned with a front of the top panel;

a top structure pivotally coupled to the top panel;

an outer annular wall extending from the top panel, the outer annular wall located further from the longitudinal axis than the inner annular wall; and a plurality of ribs extending from the top panel between the inner annular wall and the outer annular wall, wherein at least two of the plurality of ribs are parallel with respect to each other.

18. The spout of claim 17, wherein the plurality of ribs consist of three ribs, and wherein no ribs extend from the top panel and between the inner annular wall and the outer annular wall that are located more than 22.5 arcuate degrees from the front of the top panel with respect to the longitudinal axis.

19. The spout of claim 17, wherein the inner annular wall extends a first height from the top panel, wherein the plurality of ribs extend a second height from the top panel, and wherein the first height of the inner annular wall is at least three times the second height of the plurality of ribs.

* * * * *